US011849840B2

(12) United States Patent
Petker

(10) Patent No.: US 11,849,840 B2
(45) Date of Patent: Dec. 26, 2023

(54) DRAWER AND METHOD FOR INSTALLING A DRAWER

(71) Applicant: Paul Hettich GmbH & Co. KG, Kirchlengern (DE)

(72) Inventor: Waldemar Petker, Buende (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 92 days.

(21) Appl. No.: 17/611,215

(22) PCT Filed: May 4, 2020

(86) PCT No.: PCT/EP2020/062307

§ 371 (c)(1),
(2) Date: Nov. 15, 2021

(87) PCT Pub. No.: WO2020/233968

PCT Pub. Date: Nov. 26, 2020

(65) Prior Publication Data

US 2022/0225767 A1 Jul. 21, 2022

(30) Foreign Application Priority Data

May 17, 2019 (DE) ..... 10 2019 113 107.3

(51) Int. Cl.
*A47B 88/477* (2017.01)

(52) U.S. Cl.
CPC ..... *A47B 88/477* (2017.01)

(58) Field of Classification Search
CPC ..... A47B 88/477; A47B 2088/4276; A47B 2088/4278; A47B 88/427
See application file for complete search history.

(56) References Cited

U.S. PATENT DOCUMENTS 5,439,284 A * 8/1995 Grabher ..... A47B 88/427 312/334.6
5,580,139 A * 12/1996 Grabher ..... A47B 88/427 312/334.6

(Continued)

FOREIGN PATENT DOCUMENTS

CN 103142043 A 6/2013
CN 103494454 A 1/2014

(Continued)

OTHER PUBLICATIONS

International Search Report dated Jun. 15, 2020 issued in PCT/EP2020/062307 (with English translation).

(Continued)

*Primary Examiner* — Hanh V Tran
(74) *Attorney, Agent, or Firm* — Collard & Roe, P.C.

(57) ABSTRACT

A drawer has a device for securing a movable rail of a pullout guide on the drawer, and a support arranged on a side panel, on which a U-shaped holder is provided. The movable rail is insertable with a front end section into the U-shaped holder and the movable rail is lockable on the support and/or holder via at least one catch, which engages through at least one opening on the movable rail, wherein the drawer has a front panel. A method for installing a drawer on a movable rail of a pullout guide uses the device.

10 Claims, 13 Drawing Sheets

(56) References Cited

U.S. PATENT DOCUMENTS

| | | | | | |
|---|---|---|---|---|---|
| 5,588,729 | A * | 12/1996 | Berger | A47B 88/427 | 312/334.4 |
| 5,632,541 | A * | 5/1997 | Uthoff | A47B 88/467 | 312/348.1 |
| 6,913,334 | B2 * | 7/2005 | Weichelt | A47B 88/427 | 312/334.4 |
| 8,696,078 | B2 | 4/2014 | Gasser | | |
| 8,905,501 | B2 * | 12/2014 | Lee | F25D 25/025 | 312/333 |
| 9,066,587 | B1 * | 6/2015 | Liang | A47B 88/427 | |
| 9,259,087 | B1 * | 2/2016 | Hsiao | A47B 88/407 | |
| 10,299,587 | B2 * | 5/2019 | Stuffel | A47B 88/407 | |
| 10,499,736 | B2 * | 12/2019 | Chen | A47B 88/407 | |
| 10,945,523 | B2 * | 3/2021 | Albrecht | A47B 88/427 | |
| 11,464,331 | B2 * | 10/2022 | Klaus | A47B 88/427 | |
| 2003/0234603 | A1 * | 12/2003 | Salice | A47B 88/407 | 312/334.5 |
| 2004/0095047 | A1 * | 5/2004 | Salice | A47B 88/427 | 312/332.1 |
| 2009/0236959 | A1 * | 9/2009 | Liang | A47B 88/427 | 312/334.4 |
| 2009/0261700 | A1 * | 10/2009 | Chen | A47B 88/427 | 312/334.46 |
| 2013/0113356 | A1 * | 5/2013 | Salice | A47B 88/427 | 312/334.44 |
| 2013/0249366 | A1 * | 9/2013 | Gasser | A47B 88/427 | 312/333 |
| 2013/0257244 | A1 * | 10/2013 | Salice | A47B 88/423 | 312/319.1 |
| 2015/0230603 | A1 * | 8/2015 | Park | A47B 96/00 | 312/319.1 |
| 2016/0128476 | A1 * | 5/2016 | Ng | E05C 3/22 | 312/333 |
| 2016/0345732 | A1 | 12/2016 | McGregor | | |
| 2017/0035199 | A1 * | 2/2017 | Moris | A47B 88/427 | |
| 2017/0095080 | A1 * | 4/2017 | Chen | H05K 7/183 | |
| 2017/0238709 | A1 * | 8/2017 | Chen | A47B 88/483 | |
| 2017/0347794 | A1 * | 12/2017 | McGregor | A47B 88/57 | |
| 2018/0255925 | A1 * | 9/2018 | Chen | A47B 88/483 | |
| 2018/0255926 | A1 * | 9/2018 | Chen | A47B 88/427 | |

FOREIGN PATENT DOCUMENTS

| | | | |
|---|---|---|---|
| DE | 20305467 | U1 * | 9/2004 |
| DE | 202014106123 | U1 | 1/2015 |
| DE | 102015106873 | A1 * | 11/2016 |
| EP | 3491967 | A1 * | 6/2019 |
| WO | 2012068594 | A1 | 5/2012 |
| WO | WO-2016177729 | A1 * | 11/2016 |
| WO | WO-2019057590 | A1 * | 3/2019 |

OTHER PUBLICATIONS

German Search Report dated Jan. 31, 2020 issued in the corresponding German Application DE 10 2019 113 107.3 (with English translation of relevant parts).

Office Action in EP Patent Application No. 20 724 779.2 dated Nov. 4, 2022 with English translation of relevant portions.

* cited by examiner

DRAWER AND METHOD FOR INSTALLING A DRAWER

CROSS REFERENCE TO RELATED APPLICATIONS

This application is the National Stage of PCT/EP2020/062307 filed on May 4, 2020, which claims priority under 35 U.S.C. § 119 of German Application No. 10 2019 113 107.3 filed on May 17, 2019, the disclosures of which are incorporated by reference. The international application under PCT article 21(2) was not published in English.

BACKGROUND OF THE INVENTION

The present invention relates to a drawer having a device for securing a movable rail of a pullout guide on the drawer, having a support arranged on a side panel, on which a U-shaped holder is provided, wherein the movable rail is insertable with a front end section into the U-shaped holder and the movable rail is lockable on the support and/or holder via at least one catch, which engages through at least one opening on the movable rail, wherein the drawer has a front panel, and a method for installing a drawer on a movable rail of a pullout guide.

WO 2012/068594 discloses a coupling device for fixing a drawer on an extendable rail of a pullout guide. The rail is fixed on a latch part, which has a bendable spring tongue to hold the rail in the locked position. To release the latch connection, the latch part can be disengaged from the rail via a handle part. The bendable spring tongue is reinforced via a reinforcing rib to limit the bendability. In such components made of plastic, however, flowing of the plastic material can occur, so that the retention forces of the connection are reduced.

SUMMARY OF THE INVENTION

It is therefore the object of the present invention to provide a drawer having a device for securing a movable rail of a pullout guide on the drawer and a method for installing a drawer, which also ensure a secure and stable connection between the rail and the drawer for a long period of time.

This object is achieved by a drawer and by a method having the features described below.

The drawer according to the invention comprises a device for securing a movable rail of a pullout guide having a U-shaped holder, into which an end section of the rail is insertable to be locked on at least one catch. The holder is supported indirectly or directly on the front panel on a support surface, so that a bending load can be supported on the holder, which increases the stiffness of the holder and the dimensional stability. This enables stable fixing of the rail in the U-shaped holder even for a long period of time.

The U-shaped holder preferably has a bendable arm on which the support surface is formed on the side facing toward the front panel. The U-shaped holder can have a slotted receptacle, wherein the support surface is arranged offset perpendicularly to the longitudinal direction of the slotted receptacle, so that a force on the support surface results in a pivot movement on the bendable arm. The bendable arm can thus be pre-tensioned by a force on the support surface toward the slotted receptacle. The movable rail is located in the slotted receptacle in the installed position, so that improved fixing of the rail in the holder is ensured.

The bendable arm can press against the movable rail in a clamping manner in the installed position here, to be pressed with a certain pre-tension via the support surface into the installed position. The support surface does not have to press directly against the front panel, but can also be indirectly in contact with it, thus with one or more further components interconnected. In any case, the support takes place via a component which is firmly connected to the front panel. The front panel can be pre-tensioned here via at least one spring toward the holder. Such a spring can be provided, for example, in a side panel on a device for fixing the front panel, by means of which the front panel is pre-tensioned toward the side panel. The front panel can then press on the support surface in order to act on the holder, in particular on the bendable arm of the holder.

According to a first variant, the catch for locking the movable rail can be formed integrally with the support, preferably on a bendable web. The catch can be produced by forming a projection which engages in an opening on the rail for the locking. Alternatively or additionally, the catch can be arranged on a separate pivotably mounted lever which is pre-tensioned via a spring in the locked position. Such a lever can be rotatably mounted on the support, for example.

The U-shaped holder has a surface, on which the support surface is formed, on the side facing toward the front panel with respect to the installed position. This support surface protrudes from the holder toward a front side and can be subjected to pressure by the front panel or a component connected to the front panel to pre-tension the holder, in particular a bendable arm on the holder. The U-shaped holder having the bendable arm can be produced here as a molded part made of plastic. The support is preferably produced from a bent metal plate on which the holder is fixed.

If the rail has two openings offset in the longitudinal direction for locking the rail on the catch, different installation positions can be provided depending on how the structure of the drawer is at the front panel and which retention forces the connection has to withstand. The arrangement of two openings offset in the longitudinal direction also enables a pre-installation of the drawer on the rail, to then in a second installation step fix the drawer in a final installation position on the movable rail.

In the method according to the invention, the drawer is placed on two movable rails of two pullout guides to then displace the drawer along the movable rails, wherein a front end section of each of the rails is inserted into a U-shaped holder, on which a bendable arm is spread out. The movable rail is then locked on a mobile rail by the further displacement of the drawer, wherein a support surface of the holder is supported indirectly or directly on the front panel and a bendable arm on the holder is pre-tensioned toward the movable rail. Support of the holder and optimization of the connection between drawer and rail can thus be achieved during the installation.

The invention is explained in more detail hereinafter on the basis of multiple exemplary embodiments with reference to the appended drawings. In the figures:

BRIEF DESCRIPTION OF THE DRAWING FIGURES

DETAILED DESCRIPTION OF THE INVENTION

Figure 1:
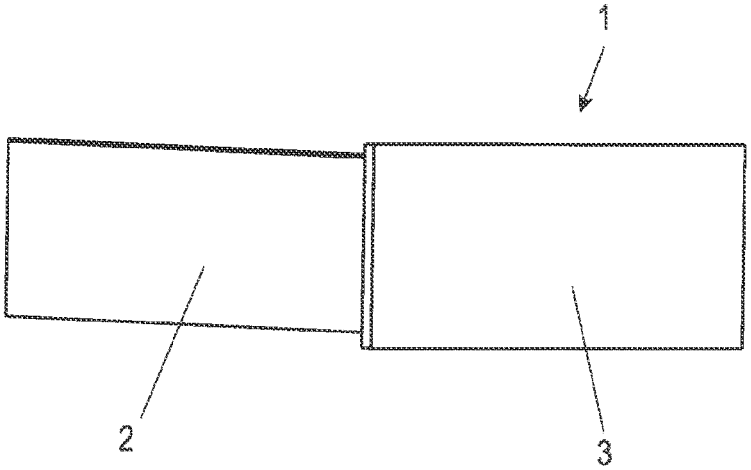
FIG. 1 shows a perspective view of a drawer.
Figure 2:
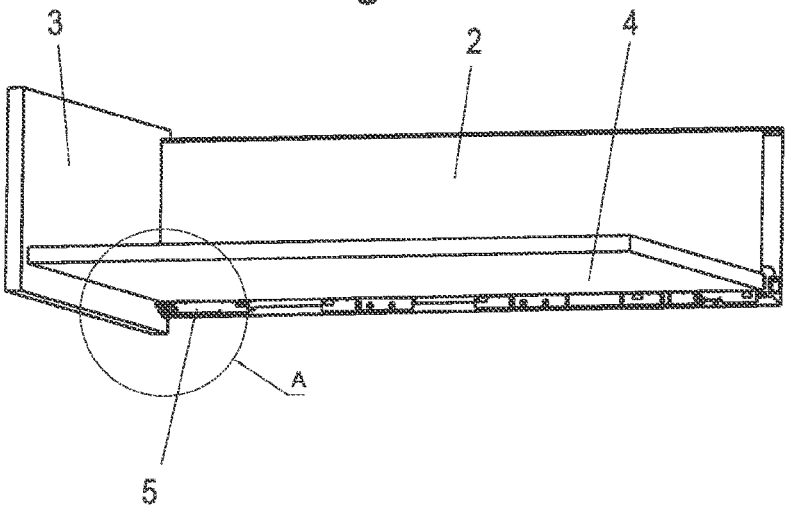
FIG. 2 shows a view of a side of the drawer of FIG. 1.

A drawer 1 comprises two side panels 2 and one front panel 3. As shown in FIG. 2, a bottom panel 4, on which a movable rail of a pullout guide is fixable, is located between the side panels 2.

Figure 3:
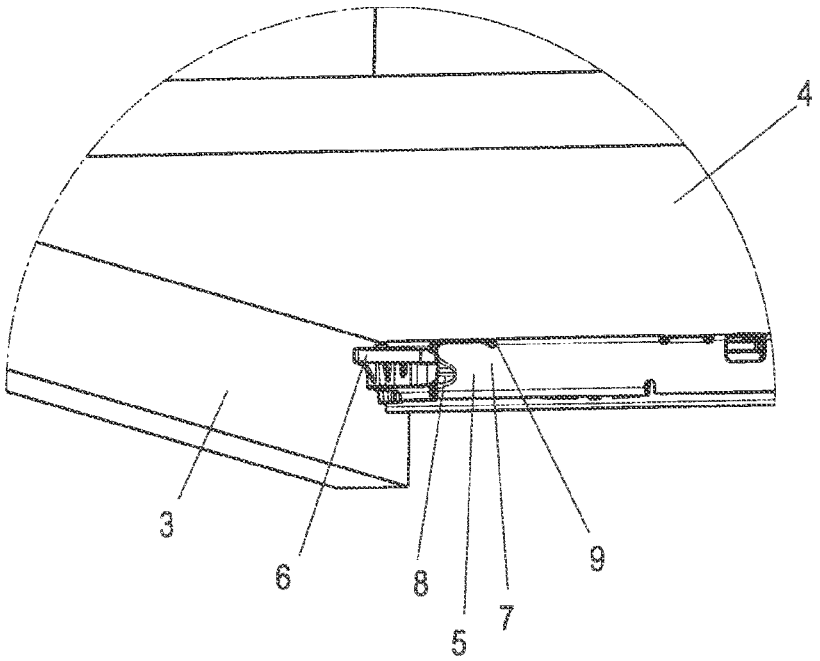
FIG. 3 shows a detail view of the drawer of FIG. 2.

As can be seen from the detail view of FIG. 3, a holder 6, which is fixed on a support 5, is located below the bottom panel 4. The support 5 can be produced from a bent metal plate and integrally includes a catch 8, which is formed as a projection or embossment and is connected via a bendable web to the support 5. A slot 9 is provided for this purpose, so that the bendable web 7 arranged in the longitudinal direction of the rail of the pullout guide is flexible.

Figure 4:
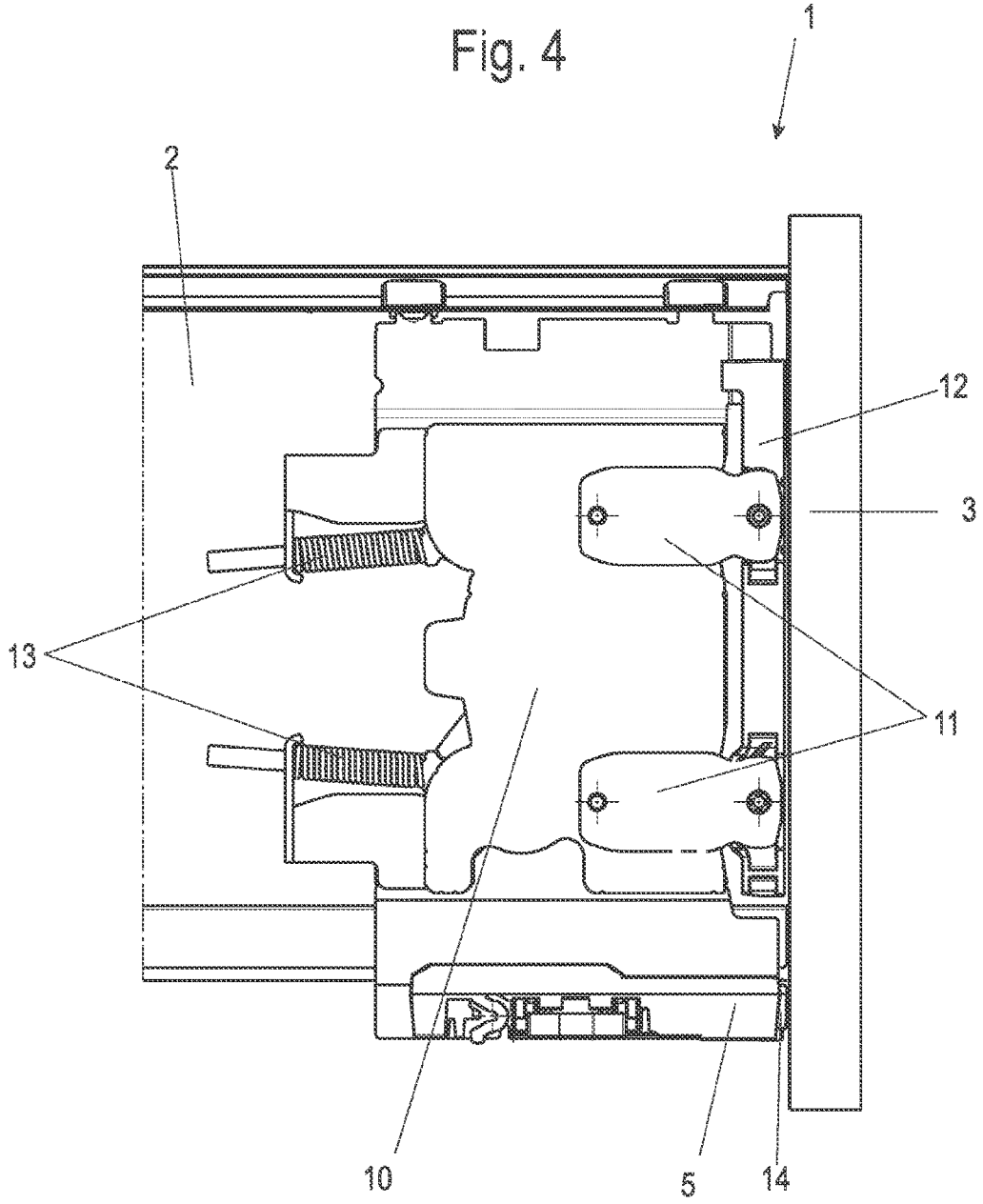
FIG. 4 shows a view of a device for fixing a front panel of the drawer of FIG. 1.

In FIG. 4, the side panel 2 is shown without a cover, so that the means 4 for fixing the front panel 3 are visible. The means 10 comprise two connecting parts 11, which are fixable on a support 12 of the front panel 3. The front panel 3 is locked via the connecting parts 11 and the support 12 and pre-tensioned via springs 13 toward the side panel 2. The front panel 3 presses against the side panel 2 in an upper region here and is pre-tensioned in the lower region toward a support surface 14 on the holder 6. It can also be provided that the front panel 3 is only secured via one or more than two connecting parts 11 on the side panel 2.

Figure 5:
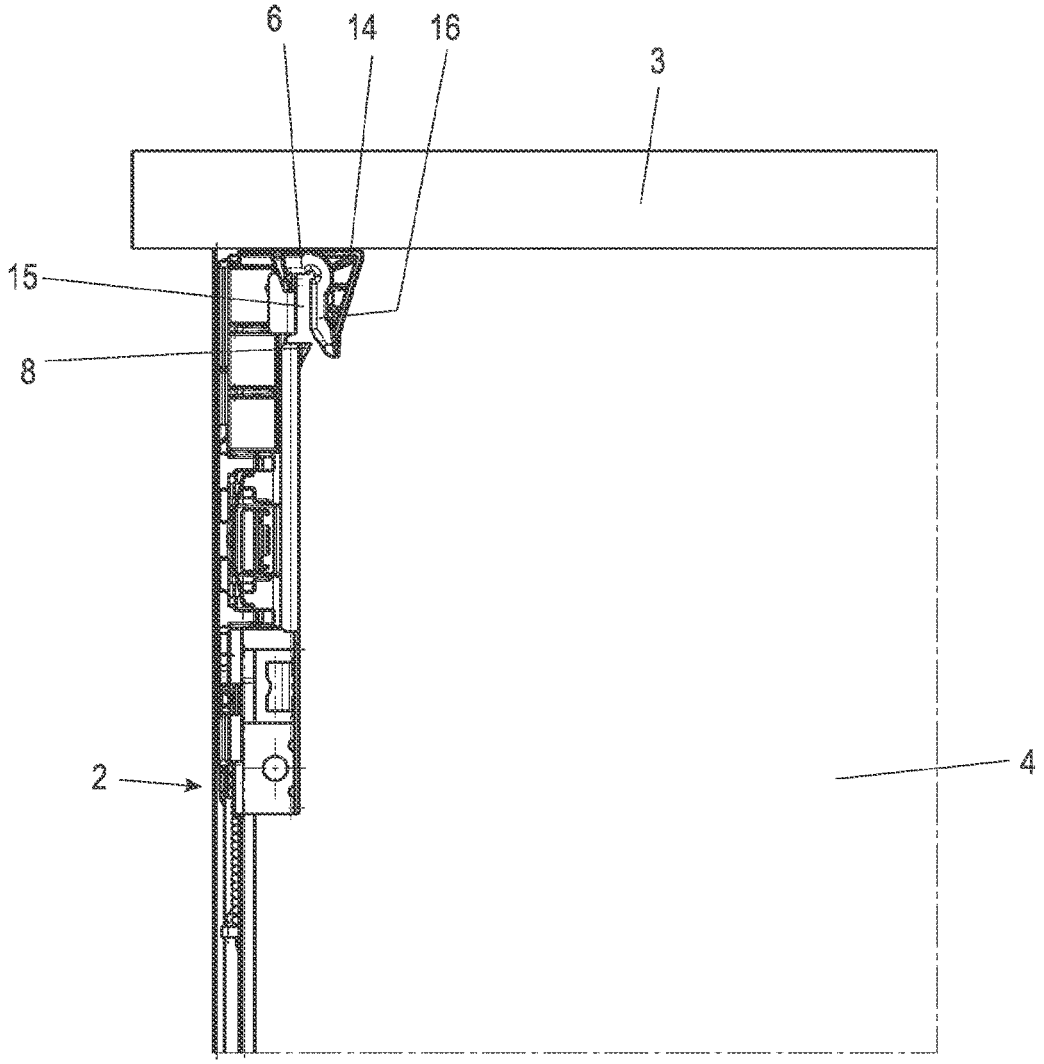
FIG. 5 shows a view of a device for securing a movable rail on the drawer of FIG. 1.
Figure 6:
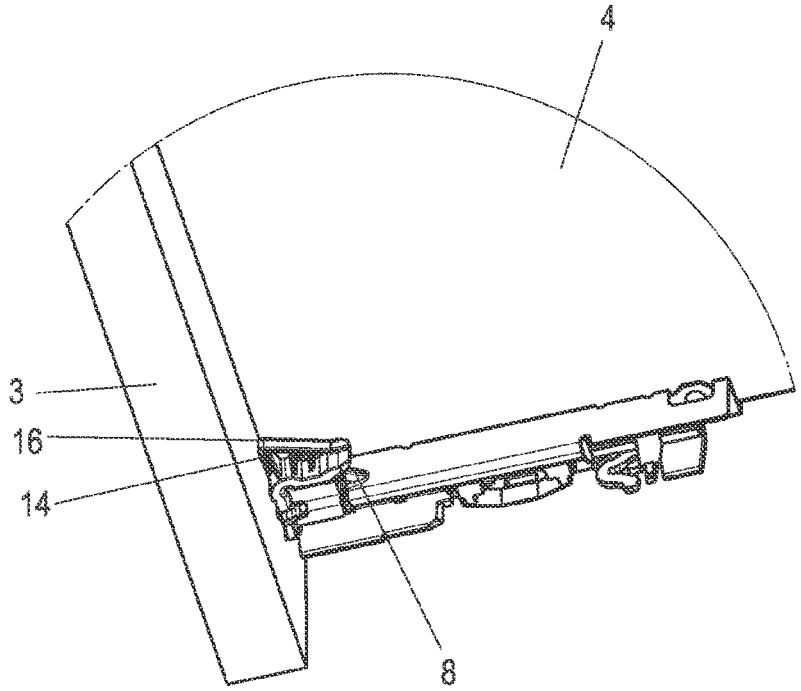
FIG. 6 shows a perspective view of the device of FIG. 5.

FIGS. 5 and 6 show a bottom view of the drawer, on which the holder 6 is shown below the bottom panel 4. The holder 6 comprises a slotted receptacle 15, which extends in parallel to the longitudinal direction of the rail of the pullout guide and is enclosed by the U-shaped holder 6. A bendable arm 16, which is integrally formed with the holder 6, is provided on the slotted receptacle 15. A support surface 14, which presses against the front panel 3, is formed on the bendable arm 16 on the side facing toward the front panel 3. It is also possible to provide further components between the support surface 14 and the front panel 3, so that the support of the support surface 14 on the front panel 3 only takes place indirectly via further components.

A catch 8, which is arranged on the bendable web 7 of the support 5, is provided on the slotted receptacle 15 on the side opposite to the bendable arm 16. The catch 8 is provided in the region of a tip of the bendable arm 16.

Figure 7:
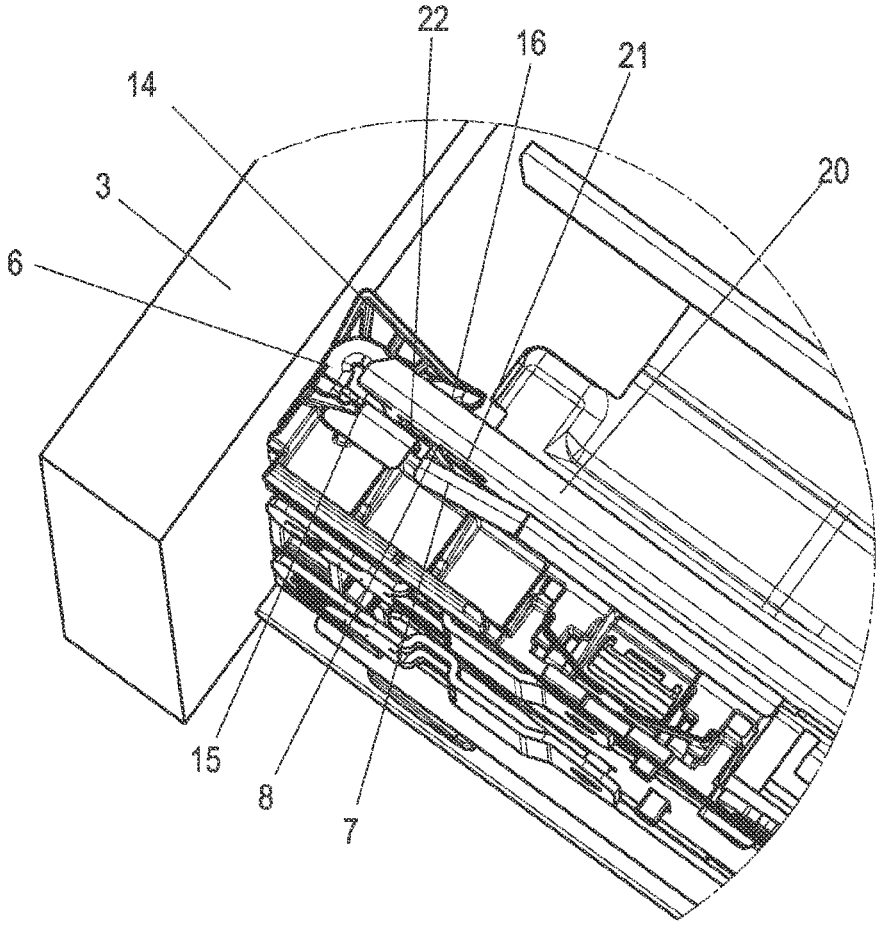
FIG. 7 shows a view of the device for securing a rail of FIG. 5 during the installation of the rail.
Figure 8:
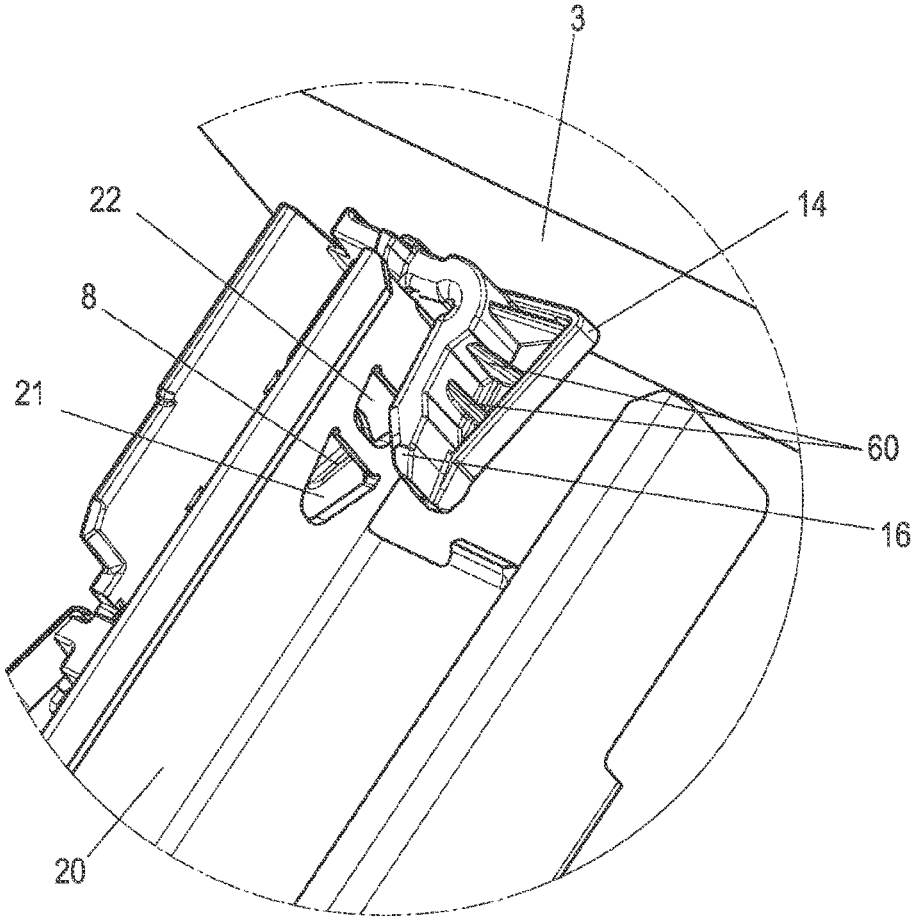
FIG. 8 shows a detail view of the device of FIG. 7.

The installation of a movable rail 20 of a pullout guide is shown in FIGS. 7 and 8. The movable rail 20 comprises two openings 21 and 22, which are arranged offset in the longitudinal direction of the rail. An intermediate position during the installation is shown in FIGS. 7 and 8, in which the catch 8 is not locked on either of the two openings 21 and 22. In this position, the bendable web 7 is deflected at the catch 8, which protrudes as a projection in relation to the rail 20. The rail 20 is thus pressed toward the bendable arm 16, which is produced from plastic and can deform. To avoid this, the bendable arm 16 is supported via the support surface 14 on the front panel 3, wherein the bendable arm 16 has multiple support ribs 60, which extend essentially perpendicular to the longitudinal direction of the rail 20. The support surface 14 is arranged offset in relation to an end of the rail 20 in a direction perpendicular to the longitudinal direction of the rail 20, for example, by 4 mm to 40 mm.

Figure 9:
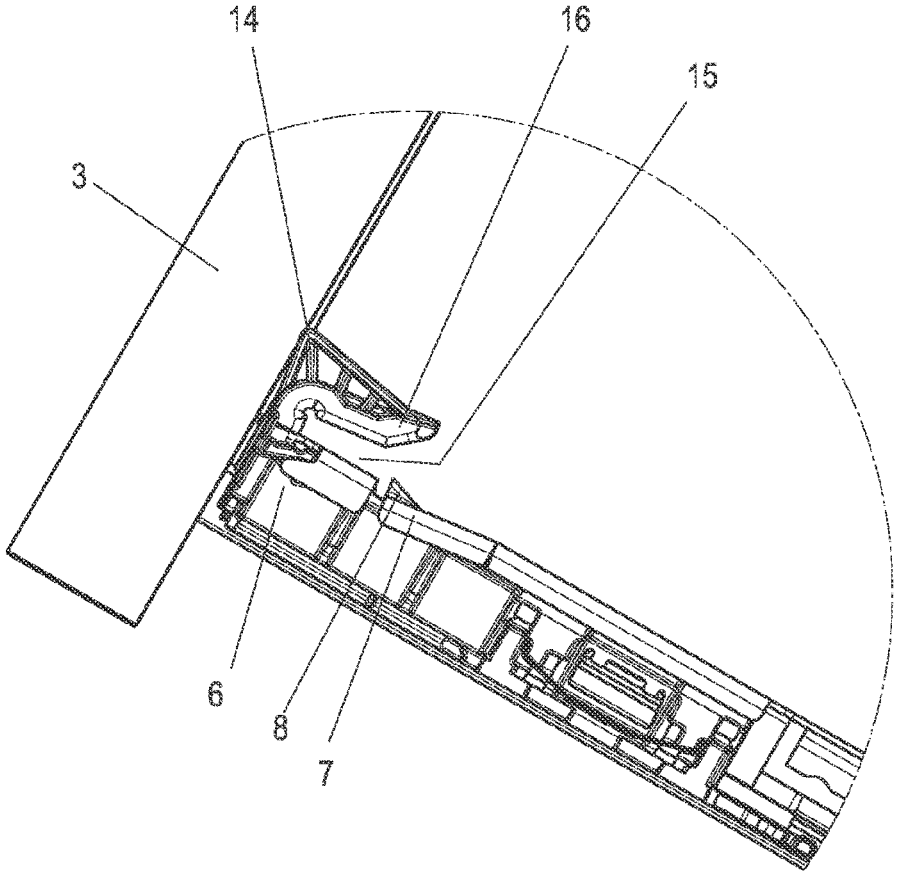
FIG. 9 shows a view of the device of FIG. 7 without rail.
Figure 10:
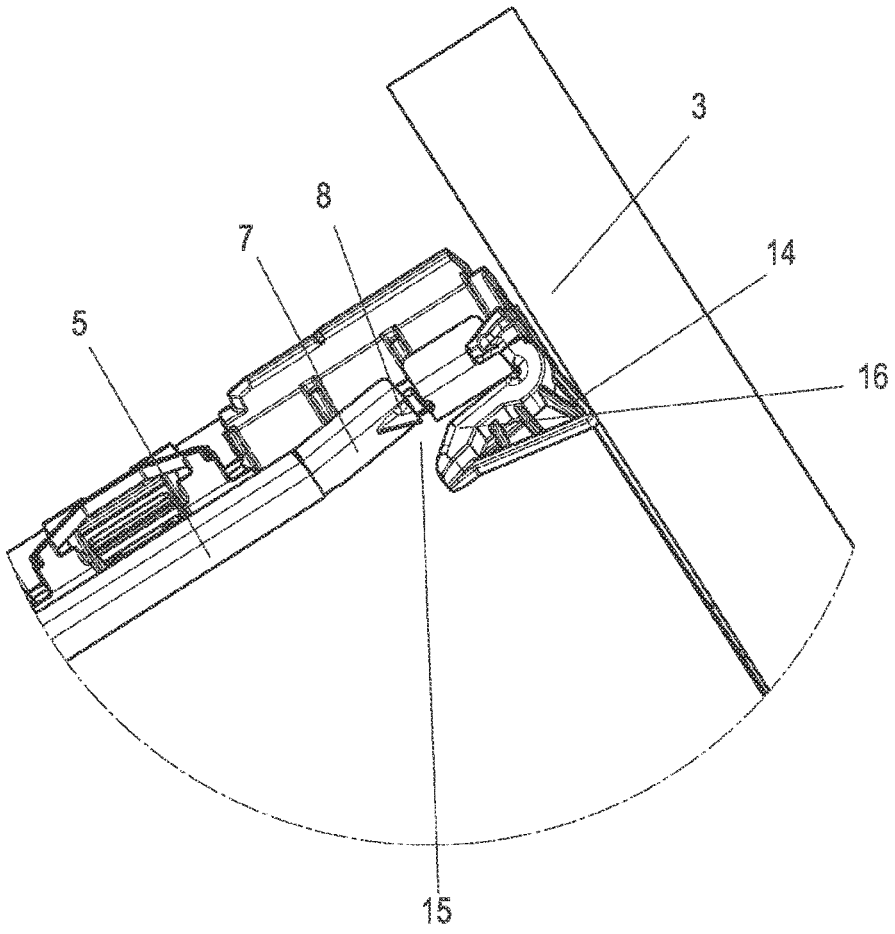
FIG. 10 shows a view of the device of FIG. 9.

The device for securing the movable rail 20 of the pullout guide is shown without the rail 20 in FIGS. 9 and 10. It can be seen that the catch 8 is pivotable on the bendable web 7 and an end section of the rail 20 can be inserted into the slotted receptacle 15. In the installation position, the catch 8 can be locked on one of the two openings 21 or 22.

Figure 11:
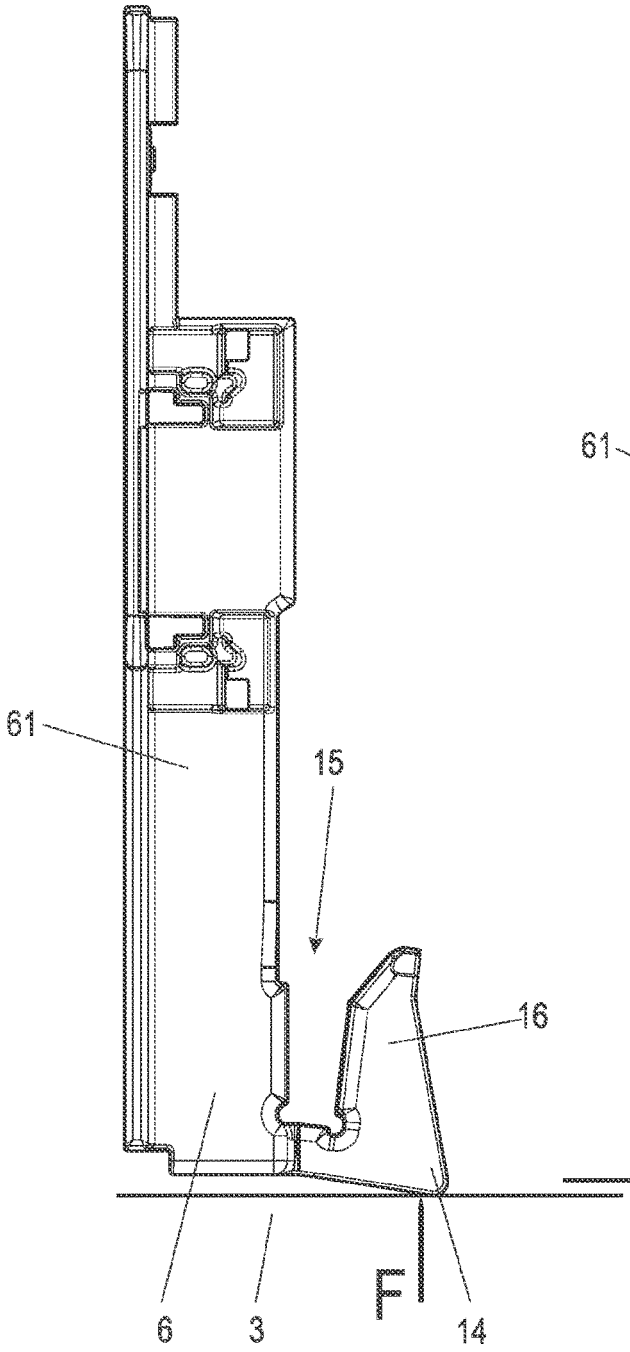
FIG. 11 shows a view of the holder of the device during the installation.

In FIG. 11, the arm 16 is shown in an installation position. During the installation, a force can act on the arm 16, which arises, for example, during the locking of the rail 20 on the catch 8, in particular if the catch 8 is not yet entirely locked on an opening. A force is then exerted via the rail 20 on the arm 16, which pivots clockwise in FIG. 11. The slotted receptacle 15 thus spreads out slightly.

Figure 12:
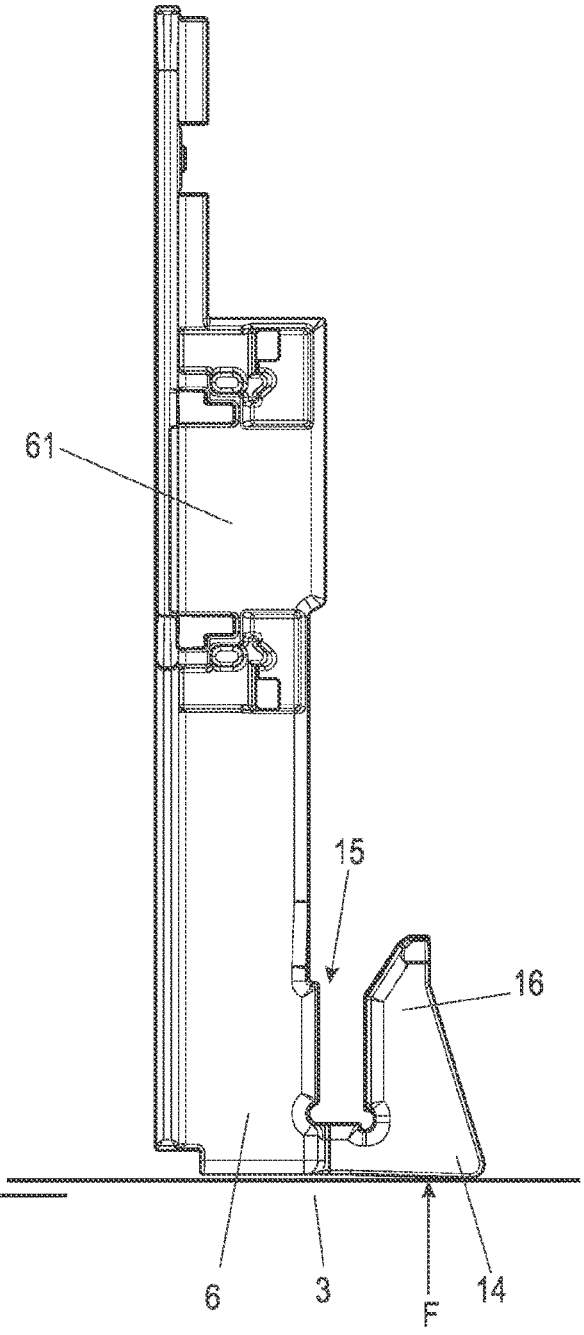
FIG. 12 shows a view of the holder of the device after the tensioning.

In FIG. 12, the rail 20 was then locked on the catch 8. A force F acts on the support surface 14 due to the front panel 3, for example, via the spring 13, by means of which the front panel 3 is pre-tensioned toward the side panel 2. The bendable arm 16 is thus pre-tensioned toward the slotted receptacle 15, as shown by the force F in FIG. 12. The bendable lever 16 thus pivots counterclockwise, as the comparison of FIGS. 11 and 12 shows. The contact surfaces opposite to one another on the slotted receptacle 15 are thus aligned essentially in parallel.

Figure 13:
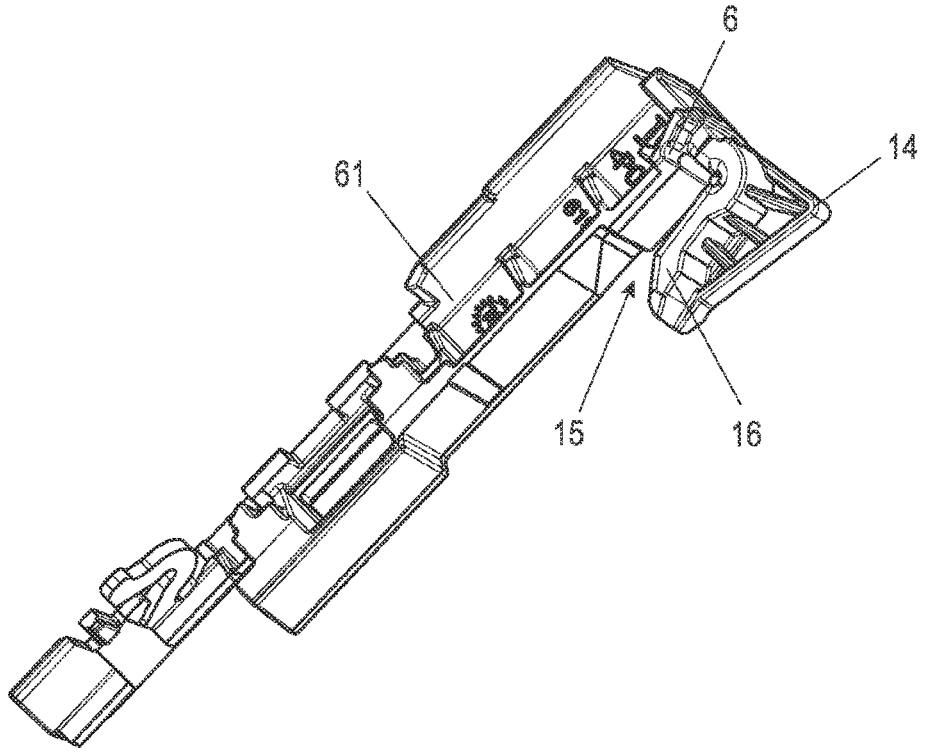
FIG. 13 shows a perspective view of the holder of the device.

In FIG. 13, the holder 6 having the slotted receptacle 15 is shown without the support 5 and without the movable rail 20. The holder 6 is produced as a molded part from plastic and can be inserted with a bar-shaped section 61 into the side panel 2 and into a receptacle on the support 5. The bendable arm 16, which is supported on the support surface 14 on the side facing toward the front panel 3, is formed integrally with the bar-shaped section 61.

In FIGS. 14A to 14D, the installation of the movable rail 20 of a pullout guide on the U-shaped holder 6 is schematically shown.

Figure 14D:
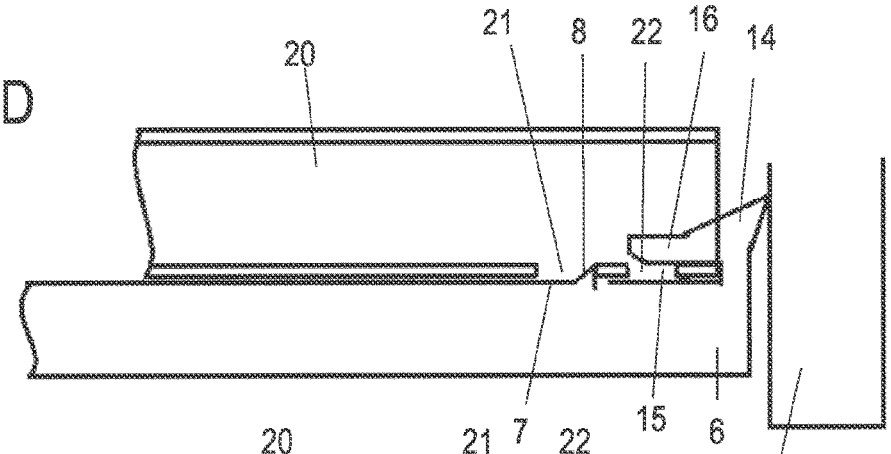
FIGS. 14A to 14D show multiple schematic views of the device during the securing of a rail of a pullout guide.
Figure 14C:
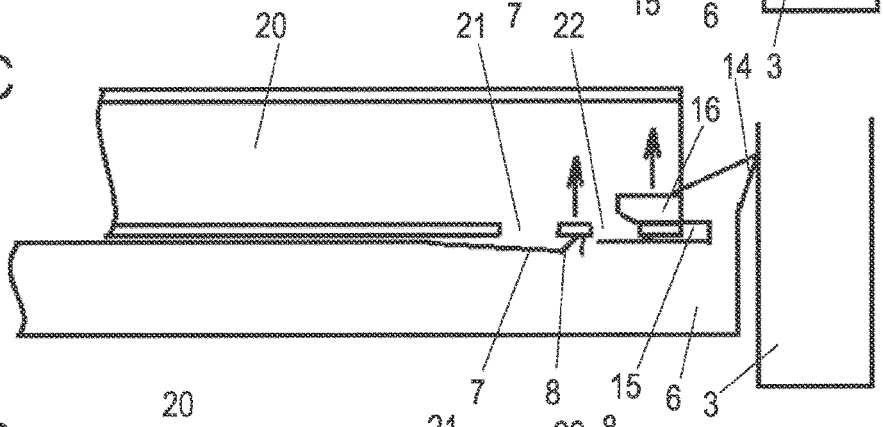
Figure 14B:
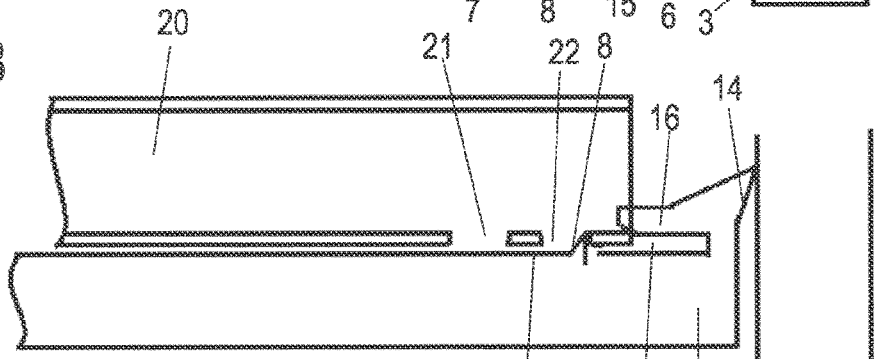
Figure 14A:
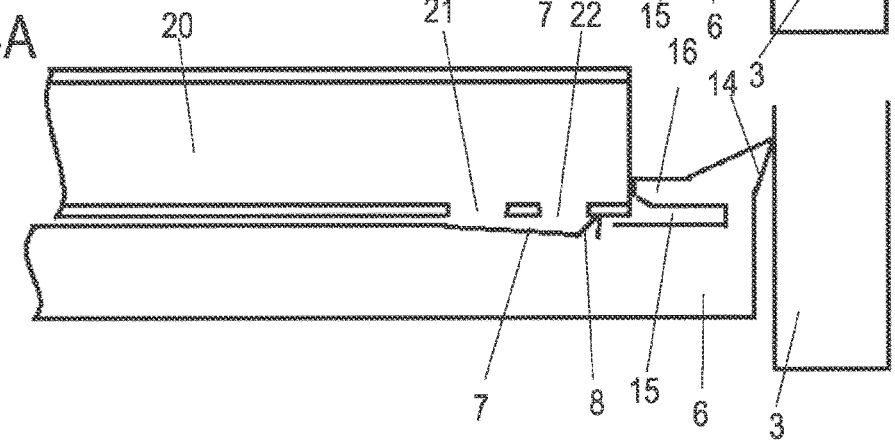

In FIG. 14A, the rail 20 is arranged in front of the bendable arm 16 of the holder 6, and a wall section of the rail 20 presses against the catch 8, which was pivoted via the bendable web 7. If the rail 20 is displaced farther along the holder 6, as shown in FIG. 14B, an end section arrives in the slotted receptacle 15 of the U-shaped holder 6. Furthermore, the catch 8 locks on the opening 22 of the rail 20. In this locked position, the rail 20 is pre-installed on the U-shaped holder 6. This position can be used for transport purposes, for example.

The position is shown in FIG. 14C when the rail 20 is inserted further into the slotted receptacle 15 of the holder 6. Due to the contact with an intake bevel on the catch 8, this is deflected again and presses against a wall section of the rail 20, as shown by the arrow. The rail 20 presses in this position against the bendable arm 16, as shown by the second arrow. The bendable arm 16 is supported by the support surface 14, which presses against the front panel 3.

The rail 20 can now be inserted further into the holder 6, until the catch 8 locks on the second opening 21. The catch 8 thus no longer presses against the rail 20, and the bendable arm 16 can pivot back, wherein the pivot movement is supported by a force from the front panel 3 on the support surface 14.

In the installation sequence of FIGS. 14A to 14D, the latch 8 is integrally formed with the support 5, which is produced from a bent metal plate. It is also possible to arrange a latch 8' on a pivotable lever 7', which is rotatably mounted on a bearing 70. The lever 7' can be rotatably mounted on the holder 6 or the support 5. The installation of a modified device for securing the rail 20 is shown in FIGS. 15A to 15D.

Figure 15D:
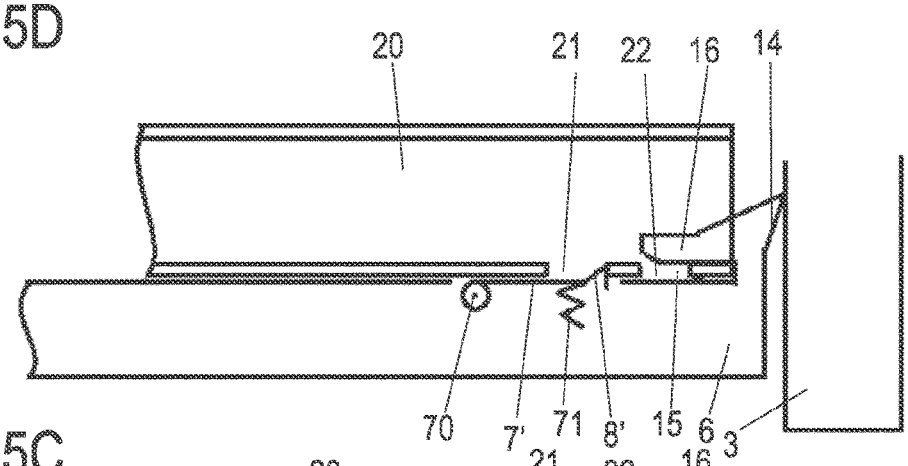
FIGS. 15A to 15D show multiple schematic views of a modified device for securing a rail of a pullout guide.
Figure 15C:
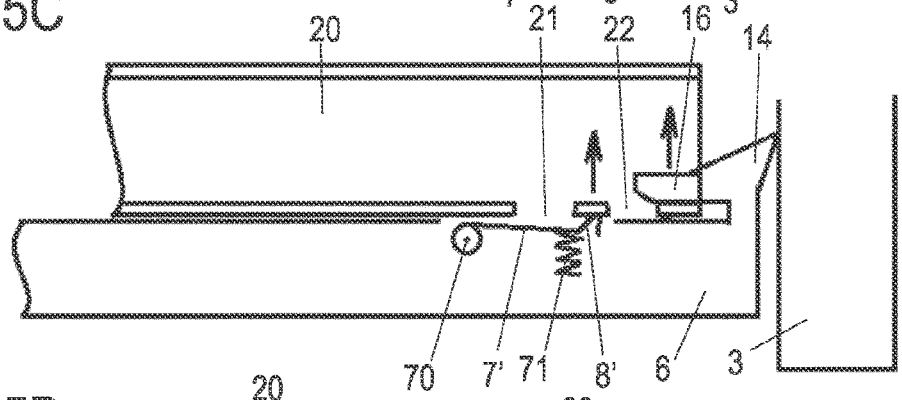
Figure 15B:
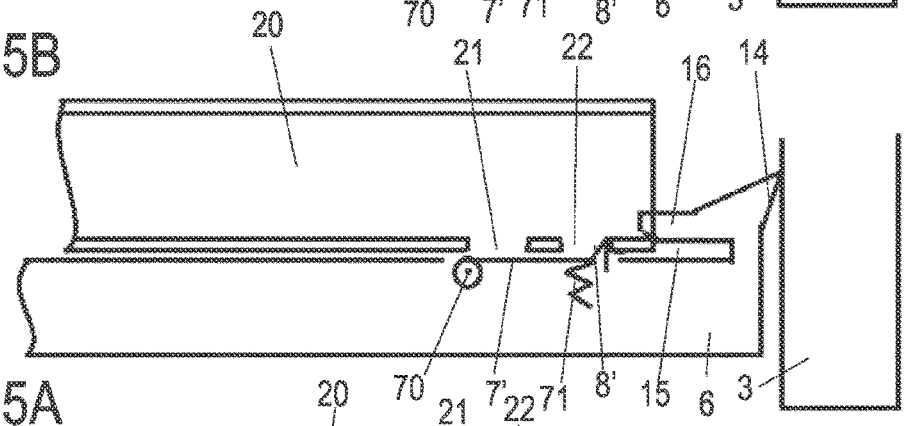
Figure 15A:
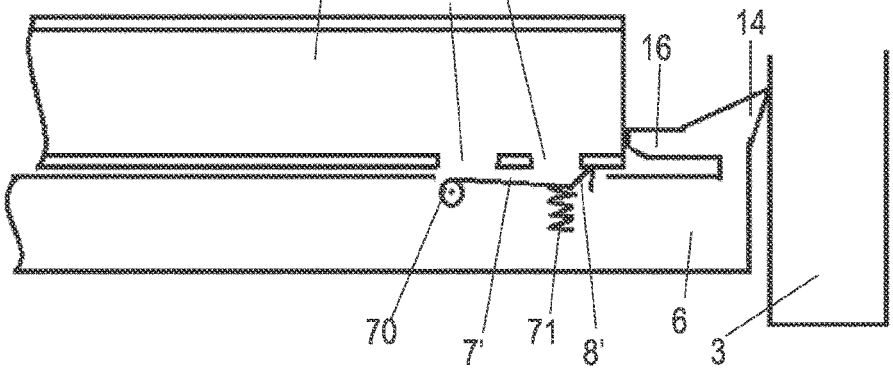

In FIG. 15A, the rail 20 is arranged adjacent to the bendable arm 16 and presses the catch 8' on the pivotable lever 7' against the force of a spring 71. If the rail 20 is now inserted further into the slotted receptacle 15 on the holder 6, as shown in FIG. 15B, the latch 8' locks on the first opening 22 of the rail 20. The lever 7' thus pivots around the bearing 70 due to the force of the spring 71. This position can be used as a transport position.

In FIG. 15C, a further installation of the rail 20 takes place, which is moved in the direction of the front panel 3, whereby the lever 7' is rotated against the force of the spring 71. In this position, the spring 71 presses against a wall section of the rail 20, which thus presses on the bendable arm 16, which can deform it. The bendable arm 16 is supported here by the support surface 14, which presses against the front panel 3.

In FIG. 15D, the installed position of the rail 20 is shown, in which the catch 8' is locked on the second opening 21. The lever 7' has thus again been pivoted by the force of the spring 71 and the bendable arm 16 has pivoted toward the slotted receptacle 15, wherein this movement was assisted by the front panel 3 and the support surface 14. The bendable arm 16 can press in a clamping manner against the rail 20 here.

In the illustrated exemplary embodiments, the rail 20 comprises two openings 21 and 22 for locking a catch 8 or 8'. Of course, it is also possible to provide only a single opening or more than two openings 21 and 22.

The support surface 14 on the holder 6 is supported directly on the front panel 3. Of course, it is also possible to provide further components between the front panel 3 and the support surface 14.

In the illustrated exemplary embodiments, the arm 16 is integrally formed with the holder 6. Of course, it is also possible to produce the arm 16 separately and mount it rotatably on the holder 6 via an axis.

LIST OF REFERENCE SIGNS

1 drawer
2 side panel
3 front panel
4 bottom panel
5 support
6 holder
7 web
7' lever
8, 8' catch
9 slot
10 means for fixing
11 connecting part
12 support
13 spring
14 support surface
15 receptacle
16 arm
20 rail
21 opening
22 opening
60 support rib
61 bar-shaped section
70 bearing
71 spring

What is claimed is:

1. A drawer (1) comprising:

a device for securing a movable rail (20) of a pullout guide on the drawer (1), and a support (5) arranged on the drawer (1), on which a U-shaped holder (6) is provided, wherein the movable rail (20) is insertable with a front end section into the U-shaped holder (6) and the movable rail (20) is lockable via at least one catch (8, 8') on the support (5) and/or holder (6), which engages through at least one opening (21, 22) on the movable rail (20), wherein the drawer (1) has a front panel (3), wherein the holder (6) is supported indirectly or directly on the front panel (3) with a support surface (14), wherein the U-shaped holder (6) has a bendable arm (16), on which the support surface (14) is formed on a side facing toward the front panel (3), and wherein the support surface (14) protrudes from the holder (6) towards a front side and is configured to be pressed against by the front panel (3) or a component connected to the front panel in order to pivot and pre-tension the bendable arm (16) against the movable rail (20).

2. The drawer according to claim 1, wherein the U-shaped holder (6) has a slotted receptacle (15) and the support surface (14) is arranged offset perpendicularly to a longitudinal direction of the slotted receptacle (15).

3. The drawer according to claim 1, wherein the bendable arm (16) presses in a clamping manner against the movable rail (20).

4. The drawer according to claim 1, wherein the front panel (3) is pre-tensioned via at least one spring (13) toward the holder (6).

5. The drawer according to claim 1, wherein the catch (8) is integrally formed with a bendable web (7) of the support (5).

6. The drawer according to claim 1, wherein the catch (8') is formed on a pivotably mounted lever (7'), which is pre-tensioned via a spring (71) into a locked position.

7. The drawer according to claim 1, wherein the U-shaped holder (6) is produced from a molded part made of plastic.

8. The drawer according to claim 1, wherein the support (5) is produced from a bent metal plate on which the holder (6) is fixed.

9. The drawer according to claim 1, wherein two openings (21, 22) offset in a longitudinal direction for locking the rail (20) on the catch (8, 8') are provided on the rail (20).

10. A method for installing a drawer (1) on a movable rail (20) of a pullout guide, comprising the following steps:

placing the drawer (1) on two movable rails (20) of two pullout guides;

displacing the drawer (1) along the movable rails (20), wherein a front end section of each of the rails (20) is inserted into a U-shaped holder (6) and a bendable arm (16) on the U-shaped holder (6) is spread out, and further displacing the drawer (1) until a movable catch (8, 8') locks the movable rail (20) on the catch (8, 8') and a support surface (14) on the holder (6) is supported indirectly or directly on a front panel (3) of the drawer, wherein the support surface (14) protrudes from the holder (6) towards a front side and is pressed against by the front panel (3) or a component connected to the front panel in order to pivot and pre-tension the bendable arm (16) against the movable rail (20).

* * * * *